United States Patent [19]

Nakamura et al.

[11] 4,186,114

[45] Jan. 29, 1980

[54] FREE-FLOWING GRANULAR DETERGENT COMPOSITIONS CONTAINING OLEFIN SULFONATES

[75] Inventors: Masayoshi Nakamura, Koshigaya; Mitsuyoshi Yazaki, Yachiyo; Toshiaki Ogoshi, Funabashi, all of Japan

[73] Assignee: The Lion Fat & Oil Co., Ltd., Tokyo, Japan

[21] Appl. No.: 939,455

[22] Filed: Sep. 5, 1978

[30] Foreign Application Priority Data

Sep. 12, 1977 [JP] Japan ..... 52-108782

[51] Int. Cl.[2] ..... C11D 1/14; C11D 17/06

[52] U.S. Cl. ..... 252/536; 252/555

[58] Field of Search ..... 252/536, 555

[56] References Cited

U.S. PATENT DOCUMENTS

| | | | |
|---|---|---|---|
| 3,705,114 | 12/1972 | Sweeney et al. | 252/555 |
| 3,950,276 | 4/1976 | Grand | 252/536 |
| 4,028,283 | 6/1977 | Murata et al. | 252/551 |
| 4,029,608 | 6/1977 | Murata et al. | 252/551 |

FOREIGN PATENT DOCUMENTS 2213156 9/1972 Fed. Rep. of Germany .

*Primary Examiner*—P. E. Willis, Jr.

*Attorney, Agent, or Firm*—Blanchard, Flynn, Thiel, Boutell & Tanis

[57] ABSTRACT

A granular detergent composition comprising α-olefin sulfonate and poly(oxyethylene)-poly(oxypropylene) alkyl ether at the weight ratio in the range of from 4:1 to 1:1 and further comprising an inorganic builder possesses satisfactory powder properties and is sufficiently easy to rinse out after being used for washing.

7 Claims, No Drawings

FREE-FLOWING GRANULAR DETERGENT COMPOSITIONS CONTAINING OLEFIN SULFONATES

BACKGROUND OF THE INVENTION

The present invention relates to granular detergent compositions which are free from deterioration of the powder properties thereof during transport and/or storage and manifest satisfactory easiness in rinsing at the time of use thereof.

It is very important to provide satisfactory easiness in rinsing of heavy duty detergents because it shortens the washing cycle and also renders it possible to economize on electric power as well as rinsing water. As the conventional means for improving the easiness in rinsing with respect to granular heavy duty detergents, there are known the art of adding soap, the art of adding silicone and/or wax, and so forth (cf. Japanese Unexamined Patent Publication No. 113504/1975 and Japanese Unexamined Patent Publication No. 157403/1975). However, the art of adding soap is not an art which promises sufficient improvement of the easiness in rinsing, and the art of adding silicone and/or wax is defective in that said silicone and/or wax adheres to the washed clothes because of their water insolubility.

It is common knowledge that nonionic surface active agents having poly(oxyethylene) chains and/or poly(oxypropylene) chains in their molecules possess low foamability. Accordingly, it can be expected that a granular detergent capable of manifesting satisfactory easiness in rinsing can be obtained by the use of nonionic surface active agents of this kind. On the other hand, granular detergents comprising such nonionic surface active agents as active ingredient are defective in that it is difficult to maintain the fluidity thereof over a long period of time and the detergent grains cake due to moisture absorption and/or compression during shipping and/or storage. In this connection, Japanese Patent Publication No. 10166/1963 discloses a granular detergent comprising poly(oxyethylene)-poly(oxypropylene) alkyl ether combined with polyphosphates which exert a favorable influence on the powder properties of granular detergents, but even this granular detergent exhibits caking due to moisture absorption and/or compression. Under such circumstances, there have hitherto been made several proposals with a view to improving the powder properties of such granular detergents comprising nonionic surface active agents as active ingredient. For instance, in Japanese Patent Publication No. 20634/1972 there is disclosed the art of mixing tripolyphosphate subjected to prehydration in granular detergents. In Japanese Unexamined Patent Publication No. 41612/1977 and Japanese Unexamined Patent Publication No. 41613/1977 there is taught the art of adding a reaction product between high-molecular ethoxylates or high-molecular polyalkylene glycols and acid anhydrides to granular detergents as an anti-caking agent.

SUMMARY OF THE INVENTION

The present inventors have energetically made a series of studies with a view to improving the powder properties of granular detergents comprising nonionic surface active agent of the aforesaid type as active ingredient, without resorting to any special means such as hydration and/or employment of an anti-caking agent, and as a result they have come to the finding that use of a mixture obtained by mixing a specific poly(oxyethylene)-poly(oxypropylene) alkyl ether with an α-olefin sulfonate at a specific ratio as active ingredient provides a granular detergent which is superior in powder properties and is satisfactory with respect to easiness in rinsing.

To be precise, a granular detergent composition according to the present invention comprises (a) an α-olefin sulfonate which has 12 to 18 carbon atoms, (b) a poly(oxythylene)-poly(oxypropylene) alkyl ether which has alkyl radical having 9 to 15 carbon atoms and contains 6 to 22 ethylene oxide units and 2 to 8 propylene oxide units added thereto and (c) an inorganic builder, and the weight ratio of (a) to (b) therein is in the range of from 4:1 to 1:1.

DETAILED DESCRIPTION OF THE INVENTION

In the present invention, the foregoing α-olefin sulfonates used as the ingredient (a) should have 12 to 18 carbon atoms in the molecule thereof in order to impart a satisfactory detergency to the granular detergent compositions. α-olefin sulfonates of this type can be prepared by the procedure comprising subjecting α-olefin mixtures having 12 to 18 carbon atoms obtained through the wax cracking process, the ethylene polymerization process employing Zieglar catalyst, or their improved process, to sulfonation by, for instance, the thin film type sulfonation process, neutralizing the thus sulfonated mixtures with caustic alkali and hydrolyzing thereafter. The thus obtained sulfonates contain monosulfonates and disulfonates, and the monosulfonate component includes alkene sulfonate and hydroxyalkane sulfonate. Increase in the content of disulfonates in α-olefin sulfonates tends to deteriorate the powder properties of granular detergents, and therefore, in the present invention, it is desirable to use α-olefin sulfonates containing disulfonates to the extent of 15 wt.% or less, preferably to the extent of 10 wt.% or less. The content of alkene sulfonate to hydroxyalkane sulfonate in the α-olefin sulfonates for use in the present invention is desirably in the range of from 40:60 to 90:10, preferably from 50:50 to 80:20, by weight.

As for the poly(oxyethylene)-poly(oxypropylene) alkyl ether used as the ingredient (b), it can be prepared by the known process of adding ethylene oxide units and propylene oxide units to straight chain or branched chain aliphatic alcohols having 9 to 15 carbon atoms by employing a basic or acid catalyst. As to the way of adding alkylene oxides, it will do either to apply the process of first effecting block addition of one of the alkylene oxides and next effecting block addition of the other thereof, or to apply the process of adding ethylene oxide and propylene oxide simultaneously to the reaction system, thereby effecting random addition.

In the granular detergent compositions of the present invention, the mixing ratio of the foregoing two ingredients (a) and (b) to be used as the active ingredient thereof is very important; unless the weight ratio of ingredient (a) to ingredient (b) is in the range of from 4:1 to 1:1, it is impossible to obtain a granular detergent composition superior in powder properties and satisfactory with respect to easiness in rinsing. In this connection, in the case where the weight ratio of (a) to (b) exceeds 4:1, sufficient easiness in rinsing is infeasible, while in the case where it is less than 1:1, powder the properties come to be inferior. It is indispensable for the granular detergent compositions of the present invention to use both ingredients (a) and (b) jointly at a specific weight ratio as a part of the entirety of the active ingredient thereof. The total amount of the active ingredient to be mixed is optionally determined conforming to that of conventional granular detergents and, generally speaking, it suffices to be in the range of from 10 to 35 wt.% of the granular detergent.

The granular detergent compositions of the present invention contain some inorganic builder. As the inorganic builder for use herein, sodium silicate, sodium carbonate, sodium tripolyphosphate, sodium pyrophosphate, sodium orthophosphate, sodium sulfate, aluminosilicate, etc. are applicable. Among these substances, sodium silicate in which the mole ratio of $Na_2O$ to $SiO_2$ is in the range of from 1:2.8 to 1:3.4 and sodium pyrophosphate are especially desirable as the inorganic builder for use in the present invention, and the use thereof will much improve the powder properties of granular detergents.

The indispensible ingredients of the granular detergent compositions of the present invention are as explained in the foregoing, but said compositions can be further mixed with not only some organic builders such as salt of polycarboxylic acids (e.g., salt of polymer of maleic anhydride or acrylic acid, salt of copolymer of maleic anhydride or acrylic acid and olefin, etc.), citric acid, trisodium nitrilotriacetate, etc., but also organic chelating agents like EDTA, fluorescent whitening agents, perfumes, etc.

Now, hereunder will be described the mertis of the granular detergent compositions of the present invention by reference to some examples embodying the invention.

EXAMPLE 1

Upon preparing a detergent slurry having a temperature in the range of from 60° to 80° C. and water content of 35 to 45 wt.%, by spraying and drying said slurry by the known spray drying method, varieties of granular detergents having a composition as shown in the following Table-I, respectively, were obtained.

Table-I

| Experiment No. | 1 | 2 | 3 | 4 | 5 | 6 | 7 | 8 | 9 | 10 | 11 | 12 |
|---|---|---|---|---|---|---|---|---|---|---|---|---|
| AOS (1) | 20 | 18 | 14 | 23 | 12 | 17 | 20 | — | — | — | 20 | 10 |
| LAS (2) | — | — | — | — | — | — | — | 20 | — | 20 | — | — |
| AES (3) | — | — | — | — | — | 3 | — | — | 20 | — | — | — |
| nonionic surface active agent (4) | 6 | 8 | 12 | 8 | 4 | 7 | 6 | 6 | 6 | — | — | 20 |
| soap (5) | — | — | — | — | — | — | — | — | — | 2 | 2 | — |
| sodium silicate (mole ratio of $SiO_2/Na_2O$) | 12 (2.9) | 10 (3.2) | 10 (2.9) | 10 (2.8) | 15 (3.0) | 15 (2.9) | 12 (2.2) | 12 (2.9) | 12 (2.9) | 12 (2.2) | 12 (3.1) | 10 (3.3) |
| sodium tripolyphosphate | 15 | — | — | 20 | — | — | — | 15 | 15 | 15 | 15 | — |
| sodium pyrophosphate | — | 15 | 15 | — | 15 | 10 | 12 | — | — | — | — | 15 |
| sodium carbonate | 10 | 10 | 10 | 5 | 0 | 10 | 10 | 10 | 10 | 10 | 10 | 10 |
| water | 8 | 8 | 8 | 8 | 8 | 8 | 8 | 8 | 8 | 8 | 8 | 8 |
| carboxymethyl cellulose | 1 | 1 | 1 | 1 | 1 | 1 | 1 | 1 | 1 | 1 | 1 | 1 |
| fluorescent whitening agent | 0.5 | 0.5 | 0.5 | 0.5 | 0.5 | 0.5 | 0.5 | 0.5 | 0.5 | 0.5 | 0.5 | 0.5 |
| perfume | 0.3 | 0.3 | 0.3 | 0.3 | 0.3 | 0.3 | 0.3 | 0.3 | 0.3 | 0.3 | 0.3 | 0.3 |
| sodium sulfate | balance | balance | balance | balance | balance | balance | balance | balance | balance | balance | balance | balance |

(Remarks)
(1) AOS: α-olefin sulfonate having 14 to 18 carbon atoms content of disulfonate = about 7 wt. %.
(2) LAS: straight chain dodecyl benzene sulfonate
(3) AES: alkyl ether sulfate having 11 to 15 carbon atoms (with about 3 ethylene oxide units added)
(4) nonionic surface active agent : poly(oxyethylene)poly(oxypropylene) alkyl ether having 12 to 14 carbon atoms (with about 10 ethylene oxide units and about 3 propylene oxide units added)
(5) soap of beef fatty acid Next, the powder properties (to wit, angle of repose, compression-caking property and hygrocaking property) and the easiness in rinsing of the respective granular detergent compositions obtained in these experiments were evaluated by the following methods. The result was as shown in Table-II.

Compression-caking property: The sample granular detergent particles were packed in a cylindrical receptacle of 10 cm in inside diameter and 15 cm in depth and thereafter a load of 5 Kg was applied thereon to form a test piece. The compression-caking property was evaluated by measuring the load (Kg) required for crushing the test piece.

Hygrocaking property: The sample granular detergent particles were charged in a carton box (22 cm×15.5 cm×5.5 cm) and allowed to stand for 7 days in a humidity box maintained at 35° C. and 85% RH, and then the box was cut open, the detergent particles were sifted carefully onto a 4-mesh sieve and the sieve was oscillated gently. The hygrocaking property was evaluated by measuring the weight percentage of the detergent particles left on the sieve, based on the total quantity of detergent particles.

Easiness in rinsing: A knit cotton undershirt worn for two days was washed by using a jet-type electric washing machine under the condition that the concentration of the detergent was 0.086%, the quantity of liquid was 30 l, the water hardness was 3° DH, the temperature was 25° C. and the time for washing was 10 minutes, and the rinsing of the wash was conducted 2 times for 3 minutes each by using water not containing any detergent under the same condition as above. After thus rinsing twice, the easiness in rinsing was evaluated by grading as follows:

A: when no foam was observed.
B: when a trace of foam was observed.

Table-II

| Experiment No. | 1 | 2 | 3 | 4 | 5 | 6 | 7 | 8 | 9 | 10 | 11 | 12 |
|---|---|---|---|---|---|---|---|---|---|---|---|---|
| angle of repose | 40 | 40 | 40 | 40 | 40 | 45 | 50 | 60 | 60 | 40 | 40 | 60 |

Table-II-continued

| Experiment No. | | 1 | 2 | 3 | 4 | 5 | 6 | 7 | 8 | 9 | 10 | 11 | 12 |
|---|---|---|---|---|---|---|---|---|---|---|---|---|---|
| powder properties | (degree) | | | | | | | | | | | | |
| | compression-caking property (Kg) | 1.7 | 1.7 | 1.9 | 1.7 | 1.9 | 1.9 | 3.0 | 5 or more | 5 or more | 1.8 | 1.8 | 4.5 |
| | hygrocaking property (%) | 35 | 30 | 30 | 30 | 30 | 30 | 50 | 85 | 80 | 30 | 30 | 70 |
| Easiness in rinsing | | A | A | A | A | A | A | A | A | A | B-C | B-C | A |

As is evident from the result shown in the foregoing Table-II, the granular detergent compositions according to the present invention (cf. Experiment Nos. 1 through 7) not only are superior in powder properties but also cause foams to disappear quickly at the stage of rinsing subsequent to the washing. On the other hand, in the case of LAS or AES, which are most popular as active ingredient for granular detergents, combined with poly(oxyethylene)-poly(oxypropylene) alkyl ether (cf. Experiment Nos. 8 and 9), they are apt to cake due to moisture absorption and/or compression. And, in the case of the granular detergent compositions prepared by adding soap (cf. Experiment Nos. 10 and 11), the easiness in rinsing thereof is not sufficient.

EXAMPLE 2

A variety of granular detergents having the following compositions respectively were prepared by applying the same procedure as in Example 1 save for varying the number of alkylene oxide units added to poly(oxyethylene)-poly(oxypropylene) alkyl ether used as nonionic surface active agent. Then, the thus obtained granular detergent compositions were subjected to evaluation of the powder properties as well as the easiness in rinsing thereof in the same way as in Example 1, excepting that the evaluation of the easiness in rinsing was conducted by increasing the concentration of detergent to 0.133%. The result was as shown in Table-III below.

| Composition of granular detergent: | |
|---|---|
| AOS (α-olefin sulfonate having 14 to 18 carbon atoms in which α-olefin sulfonate having 16 to 18 carbon atoms accounts for 85%; the content of disulfonate is about 5 wt. %) | 15% |
| nonionic surface active agent [poly(oxyethylene)-poly(oxypropylene) alkyl ether with alkyl radical having 9 to 11 carbon atoms] | 5% |
| sodium silicate (mole ratio of $SiO_2$ to $Na_2O$ = 3.1) | 15% |
| sodium pyrophosphate | 13% |
| water | 8% |
| carboxymethyl cellulose | 0.6% |
| fluorescent whitening agent | 0.4% |

-continued

| Composition of granular detergent: | |
|---|---|
| perfume | 0.2% |
| sodium sulfate | balance |

Table-III

| Experiment No. | | 13 | 14 | 15 | 16 | 17 | 18 | 19 | 20 | 21 | 22 |
|---|---|---|---|---|---|---|---|---|---|---|---|
| Average number of propylene oxide unit added | | 0 | 0 | 1 | 4 | 10 | 2 | 2 | 2 | 4 | 4 |
| Average number of ethylene oxide unit added | | 8 | 15 | 15 | 15 | 15 | 5 | 6 | 10 | 20 | 24 |
| Powder properties | angle of repose (degree) | 80 | 50 | 50 | 40 | 55 | 60 | 50 | 45 | 40 | 40 |
| | compression-caking property (Kg) | 5 or more | 3.0 | 3.0 | 2.0 | 4.5 | 2.0 | 2.0 | 2.0 | 2.0 | 2.0 |
| | hygrocaking property (%) | 90 | 50 | 50 | 30 | 50 | 30 | 35 | 30 | 30 | 30 |
| Easiness in rinsing | | C | C | B | A | A | A | A | A | A | B |

As is evident from the showing in Table-III above, in the case of a granular detergent composition in which the average number of propylene oxide unit added and that of ethyl oxide unit added are in the range specified in the present invention (cf. Experiment Nos. 16, 19 through 21), both the powder properties and the easiness in rinsing thereof are satisfactory, while in the case of a granular detergent composition in which the average number of propylene oxide unit added is 1 or less (cf. Experiments Nos. 13 through 15), it is inferior in easiness in rinsing, and in the case of a granular detergent composition in which the average number of propylene oxide units added is 9 or more (cf. Experiment No. 17), it is inferior in powder properties, particularly in respect of the compression-caking property. Further, in the case of a granular detergent composition in which the average number of ethylene oxide unit added is 5 or less (cf. Experiment No. 18), it is particularly inferior in respect of the hygrocaking property among powder properties, and a granular detergent composition in which the average number of ethylene oxid unit added is 23 or more (cf. Experiment No. 22) is undesirable because it leaves fine foams at the time of rinsing.

What is claimed is:

1. A granular detergent composition consisting essentially of

I. from 10 to 31% by weight of synthetic organic surfactant component consisting essentially of a mixture of a. alpha-olefin sulfonate having from 12 to 18 carbon atoms, and b. poly(oxyethylene)-poly(oxypropylene) alkyl ether in which the alkyl has from 9 to 15 carbon atoms, and containing from 6 to 22 ethylene oxide units and from 2 to 8 propylene oxide units, the weight ratio of component a/component b being in the range of from 10/3 to 1/1, II. the balance is essentially water-soluble inorganic builder.

2. A granular detergent composition according to claim 1, in which said alpha-olefin sulfonate contains up to 10% by weight of disulfonate.

3. A granular detergent composition according to claim 1, in which said builder is mainly sodium pyrophosphate.

4. A granular detergent composition according to claim 1, in which said organic builder is comprised of sodium silicate in which the mole ratio of $Na_2O:SiO_2$ is in the range of from 1:2.8 to 1:3.4.

5. A granular detergent composition according to claim 1, containing from 12 to 23% by weight of said alpha-olefin sulfonate, from 4 to 12% by weight of said poly(oxyethylene)-poly(oxypropylene) alkyl ether, from 10 to 15% by weight of sodium silicate in which the mole ratio of $Na_2O:SiO_2$ is in the range of from 1:2.8 to 1:3.4, up to 20% by weight of sodium tripolyphosphate, up to 15% by weight of sodium pyrophosphate, up to 10% by weight of sodium carbonate, and the balance is essentially sodium sulfate.

6. A granular detergent composition according to claim 5, containing from 15 to 20% by weight of sodium tripolyphosphate and which is free of sodium pyrophosphate.

7. A granular detergent composition according to claim 5, containing from 10 to 15% by weight of sodium pyrophosphate and which is free of sodium tripolyphosphate.

* * * * *

UNITED STATES PATENT AND TRADEMARK OFFICE

CERTIFICATE OF CORRECTION

PATENT NO. : 4 186 114

DATED : January 29, 1980

INVENTOR(S) : Masayoshi Nakamura et al

It is certified that error appears in the above-identified patent and that said Letters Patent are hereby corrected as shown below:

Column 7, line 10; change "organic" to

---inorganic---.

Signed and Sealed this

*Sixth* Day of *May 1980*

[SEAL]

*Attest:*

SIDNEY A. DIAMOND

*Attesting Officer*

*Commissioner of Patents and Trademarks*